United States Patent [19]

Fast

[11] Patent Number: 4,713,899

[45] Date of Patent: Dec. 22, 1987

[54] INFORMATION DISPLAY ELEMENT FOR SHELF AND PRICE CHANNEL USE

[76] Inventor: Jacob Fast, 7561 NW. 9th St., Plantation, Fla. 33317

[21] Appl. No.: 916,368

[22] Filed: Oct. 7, 1986

[51] Int. Cl.[4] ..... G09F 3/18; A47B 96/06

[52] U.S. Cl. ..... 40/10 R; 211/57.1; 248/205.3; 248/339

[58] Field of Search ..... 40/10 R, 359, 360, 124.1; 248/205.3, 339; 211/57.1

[56] References Cited

U.S. PATENT DOCUMENTS

| | | | |
|---|---|---|---|
| 2,159,679 | 5/1939 | Snelling | 211/72 |
| 2,222,535 | 11/1940 | Henry, Jr. | 40/20 R |
| 2,342,542 | 2/1944 | Hoofer | 40/10 R |
| 2,763,947 | 9/1956 | Hopp et al. | 40/10 R |
| 2,941,664 | 6/1960 | Palmer | 206/80 |
| 3,335,467 | 8/1967 | Freed | 40/10 R |
| 4,016,664 | 4/1977 | Kaufmann | 40/10 R |
| 4,483,502 | 11/1984 | Fast | 40/10 R |
| 4,542,286 | 9/1985 | Golarz | 40/360 |
| 4,546,943 | 10/1985 | Fast | 248/205.3 |

FOREIGN PATENT DOCUMENTS

| | | | |
|---|---|---|---|
| 812303 | 8/1951 | Fed. Rep. of Germany | 40/20 R |
| WO83/03319 | 9/1983 | PCT Int'l Appl. . | |

*Primary Examiner*—Gene Mancene
*Assistant Examiner*—J. Hakomaki
*Attorney, Agent, or Firm*—Holman & Stern, Chartered

[57] ABSTRACT

A display element is disclosed which can be used for displaying product information forwardly of an apertured product display shelf and which can be used selectively as a price channel flag for securing in a price channel in a supermarket and the like. The element is formed from a blank of plastic sheet having rectangular display and attachment panels with a transverse fold line extending therebetween. The attachment panel has a slit which forms a depressable arrow-shaped head for secruing in an aperture of the shelf adjacent the forward edge. Sections of the attachment panel adjacent the head engage the upper surface of the shelf thereby precluding upward tilting of the element. The display panel is folded down in front of the shelf and can be provided with an information display card or label. The blank also has a transverse channel-shaped slit which provides a portion of the blank located between the slit and a free upper edge of the attachment panel which can be flexed into a concave price channel so that the display panel extends below the price channel to form a price channel flag.

6 Claims, 4 Drawing Figures

INFORMATION DISPLAY ELEMENT FOR SHELF AND PRICE CHANNEL USE

BACKGROUND OF THE INVENTION

This invention relates to a display element which can be used, for example, in conjunction with a product display shelf and the like for providing product information which may be contained on a label associated with the element. The invention further relates to a display element which can be used selectively in conjunction with a product display shelf as aforesaid for providing product information, and which can alternatively be used in conjunction with a conventional concave-type price channel in a supermarket or the like, as a form of price channel flag.

I have an earlier U.S. Pat. No. 4,546,943 issued Oct. 15, 1985, which discloses an integral unit for suspending one or more apertured items for display forwardly of a display shelf, the unit being in the form of an elongate plastic strip having a mounting portion at one end which attaches the strip to a shelf, and an elongate item supporting portion with a lengthwise series of hooks for the respective items, which depends from the mounting portion. The mounting portion includes a stem with a headed end which projects from one end of the strip and which is used for attaching the strip to a shelf by squeezing the headed end of the stem into an aperture in the shelf near its forward edge. The mounting portion thus lies flat against the horizontal shelf and the item supporting portion is folded downwardly in front of the shelf.

The present invention provides a display element which can be used in conjunction with a product display shelf generally in similar manner to the unit disclosed in the prior patent, except that it may be used for providing product information rather than suspending apertured items. Further, it provides a more stabilized form of attachment to the shelf. Thus, in the earlier unit, attached by means of the headed stem, the unit is susceptible to upward tilting abount the stem which is a possible source of instability. It is a particular object of the present invention to provide a more stable form of attachment.

SUMMARY OF THE INVENTION

The invention provides a display element for attachment to an apertured shelf for displaying product information at the front of the shelf, the element being formed from a blank of plastic sheet having a display panel and an attachment panel separated by a crease or other fold line in the sheet extending transversely across the blank, the attachment panel including a substantially centrally located slit defining a depressable arrow-like head for working into an aperture of a shelf adjacent a forward edge of the shelf, thereby attaching the element to the shelf in a manner allowing the display panel to be folded down about the fold line in front of the shelf. The display panel may include peripherally located tabs, defined by channel-like slits, to form edge retainers for a product information card, label, or the like. By forming the depressable head in the body of the attachment panel, when the head is inserted into the shelf aperture, portions of the attachment panel on opposite sides of the head engage the upper surface of the shelf to form stop means precluding upward tilting of the element, and thereby forming a more stablized attachment of the element to the shelf.

In one form of the invention, the blank may include a generally transversely located channel-shaped slit having an elongate base portion adjacent the fold line and orthoginal limbs extending from the base portion toward a free end edge of the attachment panel. In this arrangement, the blank is dimensioned to enable that portion of the blank defined between the base portion of the channel and the free end of the attachment panel to be flexed into a standard concave-type price channel of the type commonly found in supermarkets and like stores, so as to secure the element therein with the display panel extending below the price channel to form a price channel flag for the display of product information.

The attachment panel and display panel, conveniently may each be of a substantially rectangular configuration, and the attachment panel may be somewhat narrower than the display panel. In a particularly convenient form of the invention, the attachment panel may be half the width of the display panel so that individual blanks may be laid out in rows, for die-cutting from a large plastic sheet, a pair of adjacent rows being reversed with the respective attachment panels being alternately nested thereby conserving sheet material.

Additional features and advantages of the invention will become apparent from the ensuing description and claims read in conjunction with the attached drawings.

DESCRIPTION OF PREFFERED EMBODIMENT

Figure 1:
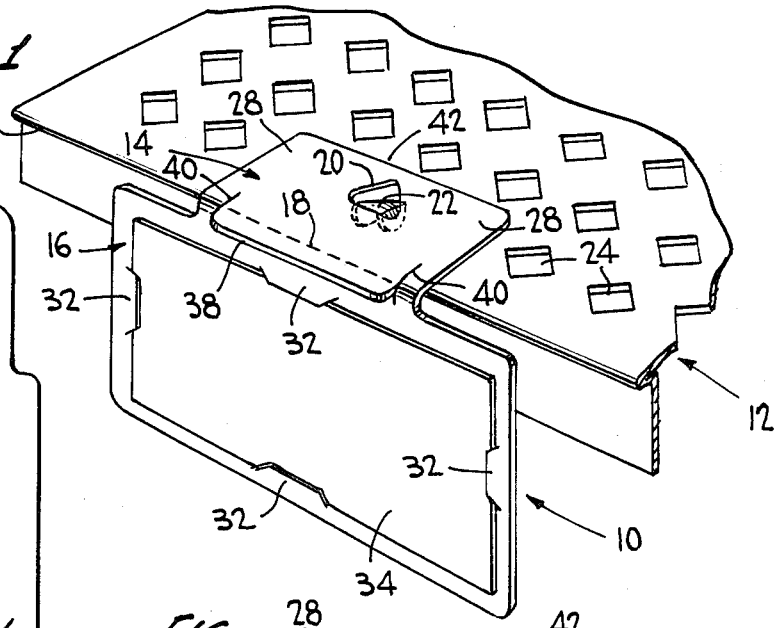
FIG. 1 is a perspective view of a product information display element in accordance with the invention attached to a product display shelf.
Figure 2:
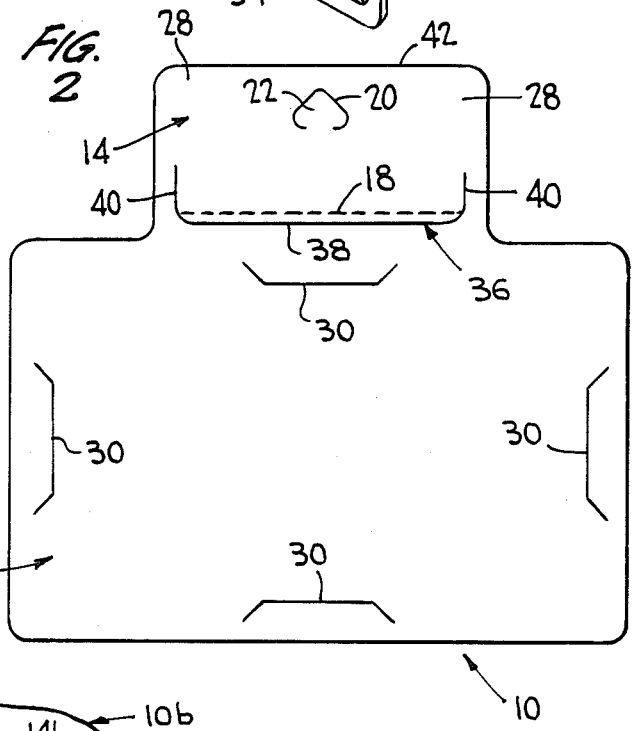
FIG. 2 is a face view of a plastic blank for forming the display element shown in FIG. 1.

Referring initially to FIG. 1, there is shown therein a product information display element 10 attached to an apertured shelf 12, for example a metal shelf used for the display of products in a supermarket or the like. Information display element 10 is folded from an intially flat blank of plastic sheet shown in FIG. 2, and comprises rectangular attachment and display panels 14 and 16 respectively with a transverse crease or other fold line 18 extending substantially between the panels. It will be noted that the respective panels are each of substantially rectangular form with attachment panel 14 being somewhat narrower than display panel 16.

Attachment panel 14 includes a substantially centrally located die-cut slit 20 defining a depressable arrow-like head 22. Head 22 is dimensioned to be somewhat oversized widthwise with respect to the shelf apertures 24, so that it may be squeezed and inserted by sliding into one of the apertures adjacent forward edge 26 of the shelf. Further, the distance between head 22 and fold line 18 is related to the distance between the forward apertures 24 and edge 26 of the shelf so that when the head 22 is inserted in an aperture as aforesaid, display panel 16 can be folded down about fold line 18 in front of the shelf for the display of product information. Because head 22 is formed in the body of panel 14, when it is used to attach the element to the shelf by insertion in one of the shelf apertures, portions 28 of panel 14 on opposite sides of head 22 engage the upper surface of the shelf, effectively preventing upward tilting of the display element as a whole, and thereby providing a stabilized form of attachment for the element to the shelf.

Display panel 16 may be provided with peripherally located channel-like slits 30 defining respective retention tabs 32 for an information label, or card 34.

In accordance with a further feature of the invention, element 10 may be provided with a channel-shaped slit 36 having an elongate transversely extending base portion 38 adjacent and parallel to fold line 18, and othogonal end limbs 40 extending toward a free end edge 42 of panel 14. Slit 36 provides the display element with a section defined between base portion 38 of the channel and edge 42 which can be flexed into a standard form of concave price channel of the type commonly used in supermarkets and the like so as to retain the element in the price channel with display panel 16 extending below the price channel to form a price channel flag.

Figure 3:
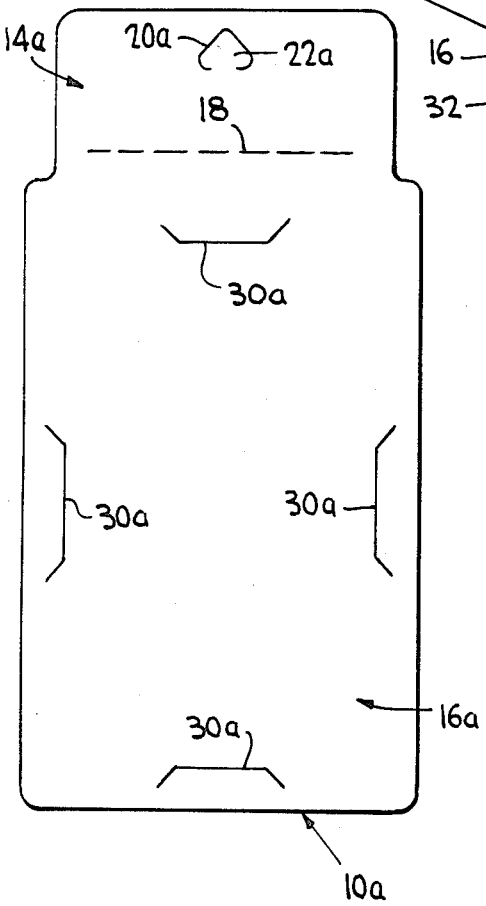
FIG. 3 is a face view of another plastic blank for forming a simliar display element.

FIG. 3 shows a modified form of display element 10*a* of generally similar configuration to previously described element 10, except that the proportions of the respective attachment and display panels 14*a* and 16*a* are somewhat different and element 10*a* does not have an equivalent of slit 36 so that it does not have the facility for being attached to a price channel. In other respects, element 10*a* can be used on a shelf in the same manner as element 10 and like references are used to denote like parts in the respective figures.

Figure 4:
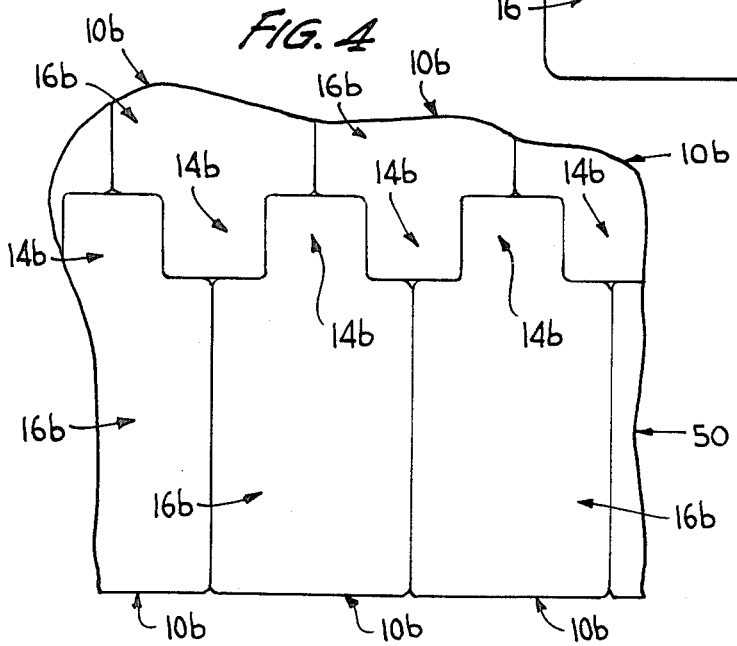
FIG. 4 is a somewhat diagramatic view of a part of a large plastic sheet showing the manner in which blanks for making the display elements can be laid out on the sheet in a nested manner conserving sheet material.

FIG. 4 shows how adjacent rows of blanks 10*b* for forming respective display elements of the type previously described can be laid out back to back for die-cutting from a plastic sheet 50. In this configuration, the respective attachment panels 14*b* of the respective blanks are configured to be half the width of the respective display panels 16*b* so that they can be alternately nested in the adjacent rows thereby conserving plastic material when the respective blanks are cut from the sheet. It will be understood, that the blanks in FIG. 4 will be provided with the respective fold lines and slits as previously described, but which, for the sake of simplicity, are not shown in FIG. 4.

It will be appreciated from the foregoing that the invention provides a versatile form of product information display element which can be used conveniently on an apertured display shelf and preferably also in a price channel for the display of product information. While only preferred embodiments of the invention have been described herein, the invention is not limited thereby and modification can be made within the scope of the attached claims.

What is claimed is:

1. A display element for attachment to an apertured shelf for displaying product information at a forward edge of the shelf, the display element comprising a plastic sheet having a display panel and an attachment panel with a fold line extending transversely across the sheet substantially at a junction between the panels, the attachment panel including a slit defining a depressable head for working into an aperture of the shelf adjacent to the forward edge and thereby attaching the element to the shelf in a manner allowing the display panel to be folded down about the fold line in front of the shelf, the slit further defining sections of the attachment panel adjacent the head for engaging an upper surface of the shelf and precluding upward tilting of the element wherein the sheet includes a generally transversely located channel-shaped slit having an elongate base portion adjacent and parallel the fold line, and orthogonal limbs extending from the base portion toward a free end edge of the attachment panel to form a portion of the sheet defined between the base portion of the slit and said free edge for flexing into a concave price channel with the display panel extending below the price channel to form a price channel flag.

2. In combination with an apertured product display shelf, a display element for displaying product information at a forward edge of the shelf, the display element comprising a plastic sheet having a display panel and an attachment panel with a fold line extending across the sheet substantially at a junction between the panels, the attachment panel including a slit defining a depressable head engaged into an aperture of the shelf adjacent the forward edge thereby attaching the element to the shelf with the display panel being folded down about the fold line in front of the shelf and sections of the display panel adjacent the head engaging an upper surface of the shelf and substantially precluding upward tilting of the element.

3. The invention as defined in claim 2 wherein the dislay panel includes securing means for an information label, card, and the like.

4. The invention as defined in claim 3 wherein the securing means comprises peripherally located slits in the display panel defining edge tabs for the label, card, and the like.

5. The invention as defined in claim 2 wherein the sheet includes a generally transversely located channel-shaped slit having an elongate base portion adjacent and parallel the fold line, and orthogonal limbs extending from the base portion toward a free end edge of the attachment panel.

6. The invention as defined in claim 2 wherein the attachment panel and the display panel are each of substantially rectangular shape and the attachment panel is somewhat narrower than the display panel.

* * * * *